United States Patent [19]

Mohr

[11] 4,015,152

[45] Mar. 29, 1977

[54] IMPACT MECHANISM FOR PIEZOELECTRIC TRANSDUCERS

[75] Inventor: Walter Mohr, Frankfurt, Germany

[73] Assignee: Braun Aktiengesellschaft, Frankfurt am Main, Germany

[22] Filed: Dec. 1, 1975

[21] Appl. No.: 636,626

Related U.S. Application Data

[63] Continuation-in-part of Ser. No. 496,588, Aug. 12, 1974, Pat. No. 3,936,678.

[52] U.S. Cl. ..... 310/8.7

[51] Int. Cl.[2] ..... H01L 41/04

[58] Field of Search ..... 310/8.3, 8.7, 9.7; 317/DIG. 11

[56] References Cited

UNITED STATES PATENTS

| | | | |
|---|---|---|---|
| 3,693,033 | 9/1972 | Troesh | 310/15 X |
| 3,826,952 | 7/1974 | Iwasaki | 310/8.7 X |
| 3,855,488 | 12/1974 | Britton et al. | 310/8.7 X |
| 3,866,069 | 2/1975 | Ishii et al. | 310/8.7 |
| 3,898,534 | 8/1975 | Mohr | 310/8.7 X |
| 3,936,678 | 2/1976 | Mohr | 310/8.7 |

*Primary Examiner*—Mark O. Budd
*Attorney, Agent, or Firm*—Frederick E. Bartholy

[57] ABSTRACT

An impact mechanism for piezoelectric transducers, particularly intended for lighters, is described. It consists of an outer housing of plastic material, at the bottom of which the piezoelectric crystal assembly is secured. Slidably arranged within this housing is a support member which contains the impact elements, namely, a permanent magnet, an actuating spring, and a ferromagnetic hammer in magnetically-locked relationship. Slots in opposite sides of the frame member permit a pin to pass through a bore in the magnet and also through the outer housing to which the pin is secured. The frame member, being closed on top, also houses a return spring. The sliding movement of the frame member within the housing compresses the actuating spring and forces separation of the hammer to strike the piezoelectric transducer.

5 Claims, 5 Drawing Figures

IMPACT MECHANISM FOR PIEZOELECTRIC TRANSDUCERS

This application is a continuation-in-part of my pending application, Ser. No. 496,588, filed on Aug. 12, 1974, now U.S. Pat. No. 3,936,678 issued Feb. 3, 1976.

BACKGROUND OF THE INVENTION

Igniters utilizing the generation of an electric spark by virtue of submitting a piezoelectric transducer to sudden mechanical stress, such as by impact, are, in their various forms, well known. The problem which faces the designer is to produce a large striking force in the minimum amount of space which pocket lighters naturally demand.

DESCRIPTION OF THE PRIOR ART

The principle of tensioning a spring in order to store energy, and releasing it to propel a solid body against a piezoelectric element, is shown in one form in U.S. Pat. No. 3,408,153. Another modification is shown in U.S. Pat. No. 3,540,823 where the piezoelectric crystals are moved to impact against each other.

Magnetic retentive means in one form is shown in U.S. Pat. No. 3,586,888 for tensioning a flat spring as the impact element. Other magnetic retentive structures of the closed magnetic circuit type are shown in applicant's U.S. Pat. No. 3,898,534.

OBJECTS OF THE INVENTION

It is the primary object of the invention herein described to provide component elements of piezoelectric impact mechanism in such form as to permit rapid and easy assembly.

It is a particular feature of the invention that the impact hammer, the actuating spring therefor, and the holding magnet, are mounted in a cradle of a support frame in locked relationship prior to assembly of the completed igniter.

It is a great advantage of the invention that only a few parts need to be assembled in a simple, easy manner, resulting in a compact igniter mechanism.

Other objects, features and advantages will be apparent from the following description of the invention, pointed out in particularity in the appended claims, and taken in connection with the accompanying drawings in which:

As mentioned before, the general principle of a hammer held by a magnetic force and a progressively greater tensioning of a spring so as to free the hammer from the retentive force, has been used in various types of embodiments. The purpose, of course, is to propel the hammer at a given velocity toward the piezoelectric element and cause such an impact therewith as to generate a voltage sufficient to cause a discharge in the form of a spark across a given gap.

Ignition systems utilizing piezoelectric crystals under stress have also been proposed for internal combustion engines as, for example, in U.S. Pat. No. 2,649,488. In such an apparatus there is, of course, no critical limitation of space.

In the construction of a lighter, however, space limitations are of paramount importance and inventors have been faced with the solution of generating a spark of sufficient energy within structurally narrow confines.

Figure 1:
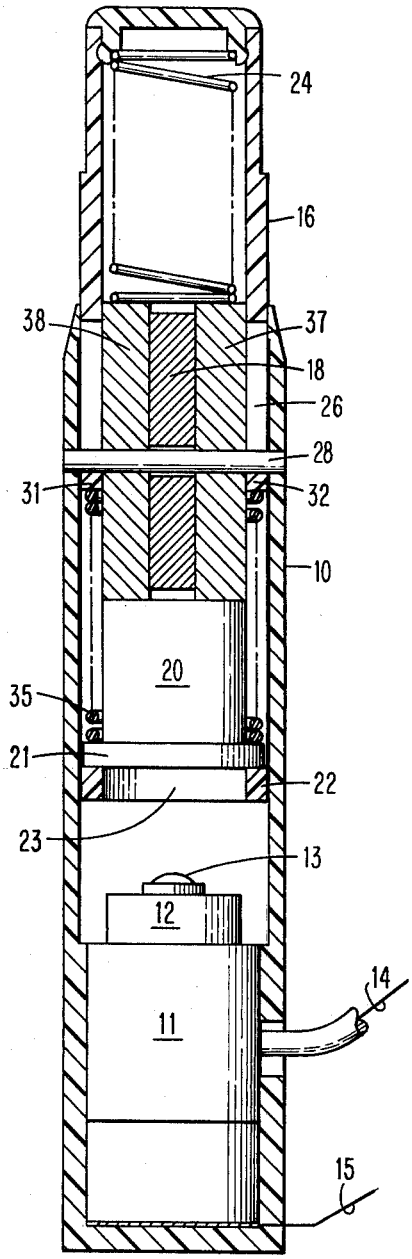
FIG. 1 is a partial cross sectional view of an assembled igniter with the impact mechanism in rest position.

Referring to the drawings, it is seen in the sectional view of FIG. 1 that the mechanism consists of an outer housing 10, indicated as being made from a plastic material, on the bottom of which is located a piezoelectric transducer assembly 11. The construction of the latter is not shown in detail since it is not the object of the present invention. Suffice it to say that it has an inwardly extending shank 12, a striking button 13, and leads 14 and 15 which are normally connected to a utilization circuit for the voltage generated by the piezoelectric transducer assembly 11 upon being subjected to stress.

Within the housing 10 is placed, in sliding fit, a support frame member 16. The latter is one of the salient features of this invention and will be discussed in greater detail in connection with FIGS. 3 and 4. As will be seen, it enables the quick and easy assembly of the impact mechanism.

Continuing with the description of FIG. 1, the impact mechanism comprises a permanent magnet 18 of special construction and a ferromagnetic hammer 20 having a rim 21 abutting against the bottom wall 22 of the frame member 16. The latter, at its upper end, defines a closed space in which is located the return spring 24 resting against the pole pieces of the magnet 18. The walls of the frame member 16 define a longitudinal slot 26 adapted to ride over a transverse pin 28. The latter runs through an appropriate bore in the magnet 18 and is secured to opposite walls of the housing 10 after the member 16 is inserted therein. In fact, by virtue of its position, the frame member becomes the actuator of the impact mechanism.

Figure 2:
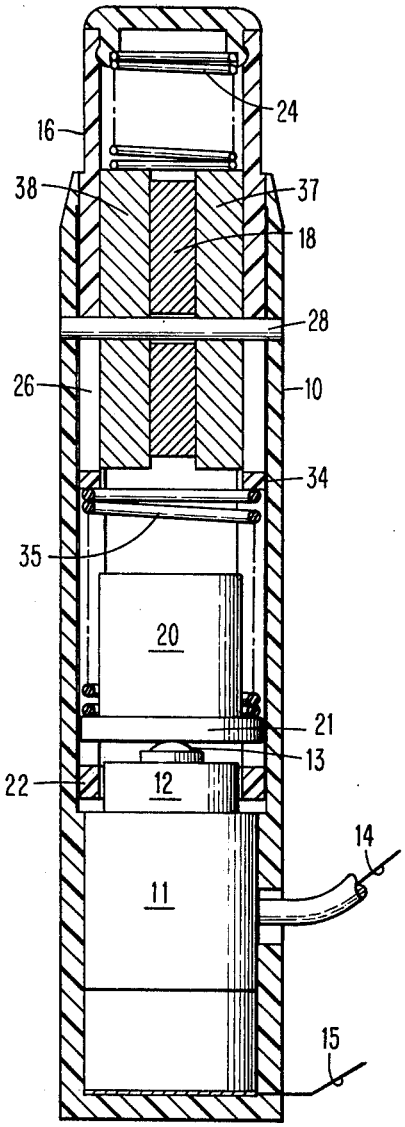
FIG. 2 is a view similar to FIG. 1 with the impact mechanism in actuated position.
Figure 3:
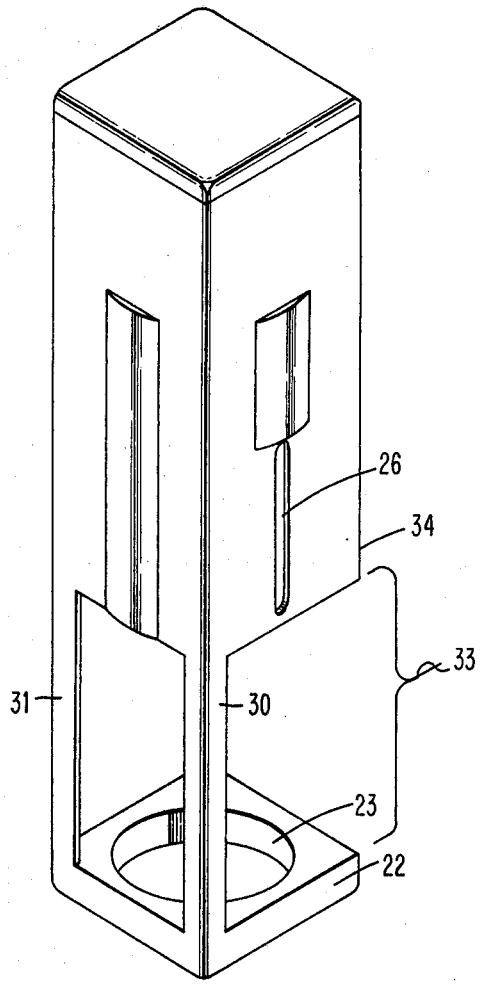
FIG. 3 is a perspective view of the support frame member showing the cradle portion into which the component parts of the impact mechanism may readily be inserted.
Figure 4:
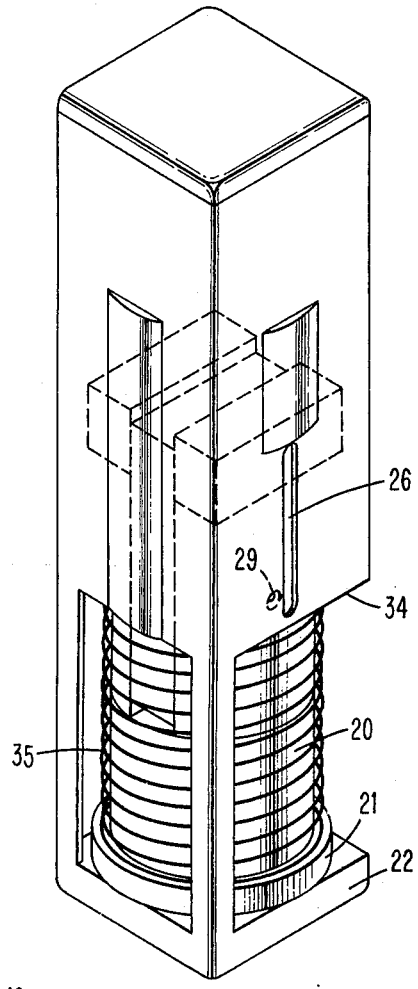
FIG. 4 is a view similar to that of FIG. 3 with the component elements of the impact mechanism inserted therein. For the sake of clearer illustration, the return spring is not included.
Figure 5:
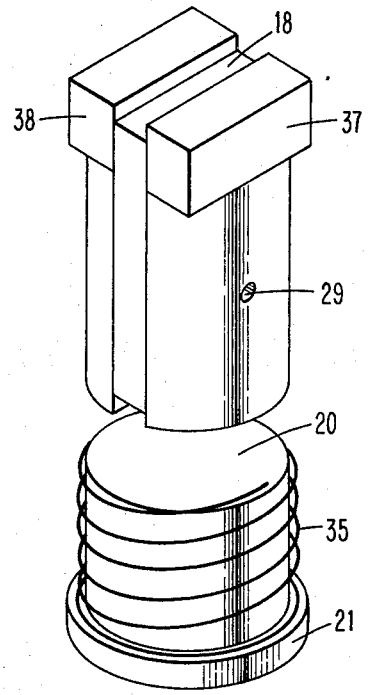
FIG. 5 is an illustration in a perspective rendition of the magnet construction and the hammer in their physical relationship with the actuating spring partially shown.

Prior to describing the operative position of the impact mechanism illustrated in FIG. 2, reference should be had to FIGS. 3, 4 and 5.

In FIG. 3 we see that the support frame member consists of an oblong housing of which part of the lower portion is open. It terminates in a bottom wall 22 having an opening 23. It is supported by three legs 30, 31 — visible in the illustration — and 32 (FIG. 1) oopposite from that of 31 — hidden in this view. By virtue of its open side, this construction forms a "cradle" 33 into which the impact mechanism parts may easily be inserted without difficult assembly of such elements as in prior art structures.

One of the slots 26, mentioned in connection with FIG. 1, is clearly seen. The bottom wall 22 forms a solid base for the rim 21 of the hammer 20 to rest thereon. The magnet 18, by virtue of its rectangular configuration at the top, may easily slide within the upper portion of the frame member 16.

The completed assembly is shown in FIG. 4. The rim 21 of the hammer rests on the bottom wall 22 and the magnet 18, shown in dotted line, extends into the upper portion of the frame member 16. The bore 29 of the magnet is aligned with the slot 26 so that when the frame member 16 is placed into the housing 10, the locking pin 28 may easily be inserted and thereafter made secure to the wall of the housing 10. As seen, the frame member 16 is ready for assembly into the igniter structure to become the actuating element thereof. The hammer 20 is attracted to the magnet 18 with extremely strong force with respect to its small size, inasmuch as a closed magnetic circuit is achieved by this construction.

It is to be noted that the actuating spring 35 is neatly held within the cradle 33, namely, by the edges of the upper walls 34 of the frame member 16 and by the rim 21 of the hammer 20. This is an important feature and should be carefully considered because it will be seen with reference to FIG. 2 that, upon depression of the member 16, it is the edges of walls 34 which contact and thereby compress the actuating spring 35 while the magnet 18 is solidly held within the frame member 16 by the pin 28.

Referring to FIG. 5, the magnet 18 is of special construction. It is an oblong shaped permanent magnet having the magnetizing force distributed on the lateral faces thereof, against which are affixed the pole pieces 37 and 38. It is to be noted that the magnet 18 is shorter in length than its pole pieces so as to form, on the bottom thereof, an extremely strong permanent magnet with distinct magnetic poles at the extremities.

Referring to the operation of the igniter mechanism, it is seen (FIG. 2) that when the actuating member 16 is depressed, it is sliding downwardly and the edges of the walls 34 depress the spring 35. As this motion continues, a point is reached when the energy stored in the spring 35 is sufficient to free the hammer 20 from the retention of the magnet 18. At that instant, or previous thereto, the bottom wall 22 rests over the shank 12 of the transducer 11 and the hammer 20 impacts the striking button 13 thereof with considerable force. Thus a voltage pulse is generated which is conducted to a utilization circuit through the leads 14 and 15.

Upon release of the pressure on the sliding frame member 16, the return spring 24, which was compressed during the aforesaid operation, causes member 16 to be lifted up so that the hammer 20 is retracted by the bottom wall 22 to a position where it again encounters the attraction of the magnet 18 and becomes solidly attached thereto as seen in FIG. 1. This operation may be repeated at any desired interval, each time resulting in the generation of a high voltage pulse between the leads 14 and 15.

The impact mechanism of this invention represents a compact operating structure of which — as mentioned before — the assembly of the component elements is extremely simple. The cradle 33 retains the spring 35 and the frame member 16 houses the impact mechanism. The hammer 20 is not subject to retraction simply by magnetic force but is physically moved up ready for the next operation.

The invention represents a compact mechanism which unfailingly forces separation of the hammer 20 from the magnetic force and is withdrawn, upon vertical sliding motion, to be coupled once again with the permanent magnet.

The invention in its broader aspects is not limited to the specific embodiment herein shown and described but changes may be made within the scope of the accompanying claims without departing from the principles of the invention and without sacrificing its chief advantages.

What is claimed is:

1. An impact mechanism for piezoelectric transducers for use in lighters, including an outer housing accommodating said transducer, a support frame member slidably arranged within said housing and extending therefrom for manual actuation, said member incorporating a return spring, an actuating spring, a permanent magnet, and a striking hammer in magnetically retentive relationship, slots in said frame member accommodating a pin transverse to said housing and affixed thereto, said pin passing through a bore in said magnet, whereby upon inward movement of said member within said housing, said spring is compressed by said member, causing said hammer to overcome the retentive force of said magnet and impact upon said transducer.

2. A mechanism in accordance with claim 1, wherein said member has walls defining a cradle into which the component elements of said impact mechanism may easily be inserted.

3. A mechanism in accordance with claim 1, wherein said member has a bottom wall and said hammer has a rim adapted to rest thereon, said wall having an opening permitting access of said hammer to encounter said transducer upon lowering of said wall over a shank of said transducer beyond the striking surface thereof.

4. An impact mechanism according to claim 1, wherein said member is so dimensioned that the edges of the walls thereof engage said actuating spring, causing compression thereof upon movement of said member in the direction inward of said outer housing.

5. A mechanism in accordance with claim 1, wherein said permanent magnet is so dimensioned as to slidably fit within said member and comprises an oblong-shaped magnet having semi-cylindrical pole pieces extending beyond said magnet, said hammer, contacting said pole pieces, completing a closed magnetic circuit thereof.

* * * * *